US005803370A

United States Patent [19]

Heinz et al.

[11] Patent Number: 5,803,370

[45] Date of Patent: Sep. 8, 1998

[54] FUEL INJECTION VALVE FOR INTERNAL COMBUSTION ENGINES

[75] Inventors: Rudolf Heinz, Renningen; Roger Potschin, Brackenheim; Friedrich Boecking, Stuttgart, all of Germany

[73] Assignee: Robert Bosch GmbH, Stuttgart, Germany

[21] Appl. No.: 761,589

[22] Filed: Dec. 6, 1996

[30] Foreign Application Priority Data

Dec. 9, 1995 [DE] Germany ..... 1 95 46 033.2

[51] Int. Cl.[6] ..... F02M 63/00

[52] U.S. Cl. ..... 239/533.9

[58] Field of Search ..... 239/589, 533.2–533.12, 239/600; 251/129.02, 129.05

[56] References Cited

U.S. PATENT DOCUMENTS

| | | | |
|---|---|---|---|
| 3,361,353 | 1/1968 | Millman | 239/584 X |
| 4,669,660 | 6/1987 | Weber et al. | 251/129.05 X |
| 4,730,785 | 3/1988 | Seifert | 239/533.3 X |
| 4,750,675 | 6/1988 | Sczomak | 239/533.3 X |
| 4,907,748 | 3/1990 | Gardner et al. | 239/584 |
| 4,911,366 | 3/1990 | Priesner | 239/533.3 |

FOREIGN PATENT DOCUMENTS

3533085A1 3/1987 Germany .

*Primary Examiner*—Kevin Weldon
*Attorney, Agent, or Firm*—Greigg & Greigg

[57] ABSTRACT

The invention sets forth a fuel injection valve for internal combustion engines, which includes a valve member, axially displaceably guided in a valve body. The valve member includes a sealing face on an end toward a combustion chamber which cooperates with a valve seat face provided on the valve body in order to control an injection port. The injection port communicates on an end remote from the combustion chamber with a final control element for actuating the valve member. The injection valve has a hydraulic damping device which when stoppage of the valve member in an intermediate position between contact with the valve seat and the maximum opening stroke is controlled by the piezoelectric final control element keeps the valve member in that stroke position.

20 Claims, 2 Drawing Sheets

FUEL INJECTION VALVE FOR INTERNAL COMBUSTION ENGINES

BACKGROUND OF THE INVENTION

The invention is based on a fuel injection valve for internal combustion engines. In a fuel injection valve of this kind known from DE-OS 35 33 085, the valve member is actuated axially movably in a valve body by a piezoelectric final control element. For that purpose, on its end oriented toward the combustion chamber, the valve member has a valve sealing face with which it cooperates with a valve seat provided on the valve body. On its end remote from the combustion chamber, the valve member is coupled to the piezoelectric stack of the piezoelectric actuator. The stroke motion of the valve member for opening the injection cross section ensues as a result of the length change of the piezoelectric stack, wherein the valve member is kept in constant contact with the piezoelectric stack by means of a hydraulic or mechanical coupler.

The use of such piezoelectrically actuated fuel injection valves is advantageous particularly in fuel injection systems in which a common pressure storage chamber (common rail) is provided, which is filled with high fuel pressure by a high-pressure pump, and from which the injection lines lead away to the individual fuel injection valves. The instant of injection time is thus freely selectable via the piezoelectrically triggered injection valves, while a high fuel pressure is constantly applied.

For an optimal shaping of the course of injection, it is advantageous in certain operating ranges of the engines to be supplied to interrupt the reciprocating motion of the valve member in certain intermediate positions and to keep the valve member in that position, so that initially a certain smaller fuel quantity is injected into the combustion chamber, before the main injection quantity follows it.

This is made possible by the fuel injection system described above, but there the disadvantage arises that the system becomes low-frequency as a consequence of the hydraulic or mechanical coupling of the fixed body actuator, as a control element, to the valve member. When the valve member rises from the valve seat, the natural frequency is induced, which as a consequence, in the holding position of the valve member, causes an overswing at the valve member and thus a fluctuating opening cross section and hence a nonuniform injection quantity.

OBJECT AND SUMMARY OF THE INVENTION

The fuel injection valve of the invention for internal combustion engines has the advantage over the prior art that by the provision of a damping or fixing device acting on the valve member, the valve member can be fixed in intermediate positions in such a way that vibration is reliably suppressed, so that even in these controlled partial opening cross sections of the injection valve, a constant fuel quantity is injected into the engine combustion chamber. The final control element that actuates the valve member is advantageously embodied as an electromagnet controller or piezostack, but mechanical or hydraulic final control elements are also possible.

The damping force transmitted to the valve member is designed to be only great enough that vibration of the valve member is reliably suppressed, yet the reciprocation speed of the valve member is not substantially affected. The damping device, embodied in the present exemplary embodiment as a hydraulic damper, engages the piezostack connecting rod, but it is also possible to provide the damper correctly on the shaft of the valve member.

The damping or fixing device acting on the valve member reciprocating motion may, as in the exemplary embodiment described, be embodied as a hydraulic damper, but it is alternatively possible for the damping or fixation to be accomplished by other means, for instance pneumatically, electromagnetically or electrohydraulically. To that end, it would for instance be possible to use a piezorestrictive clamping element that engages the valve member shaft or the piezostack connection and that in the stopped state of the valve member in an intermediate position prevents any further axial motion. This clamping element may be embodied as a clamping ring or as a clamping bolt that radially engages the valve member; when a control voltage is applied, these clamping elements fix the valve member or the piezostack connecting rod in an intermediate position.

German Patent 30 41 018 shows a stationary damping chamber, but in that patent it is used merely to slow down the opening stroke speed of the valve member. An arbitrary persistence of the valve member in an intermediate position is not possible in the injection valves, so that in them the problem of positioning the valve member without vibration in which intermediate position does not arise, either.

The damping device of the invention is advantageously embodied by a piston that is movable on the piezostack connecting rod or alternatively on the valve member shaft; with one end face, the piston defines a damping chamber, and with its second end face it defines a storage chamber for the hydraulic medium that is at constant pressure, the two chambers formed inside the valve member bore communicates with one another constantly via at least one throttle line. This compact, structurally very simple damping device has the advantage that it requires no expenditure for electronics or control technology and is moreover highly functionally reliable.

The throttle line is advantageously designed such that given adequate damping force in the stopped state of the valve member, no substantial slowing of the opening stroke motion of the valve member ensues.

The damping device may be embodied as a unilaterally acting or alternatively as a bilateral spring damper; it is especially simple to use the piston as a bilaterally acting damper.

To avoid the development of negative pressure in the damping chamber during the closing stroke motion of the valve member, a further connecting conduit is also provided between the damping chamber and the storage chamber; it is opened during the closing stroke motion, and at the onset of the opening stroke motion it is closed by a sealing seat on the shaft of the piezostack connecting rod or the valve member.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
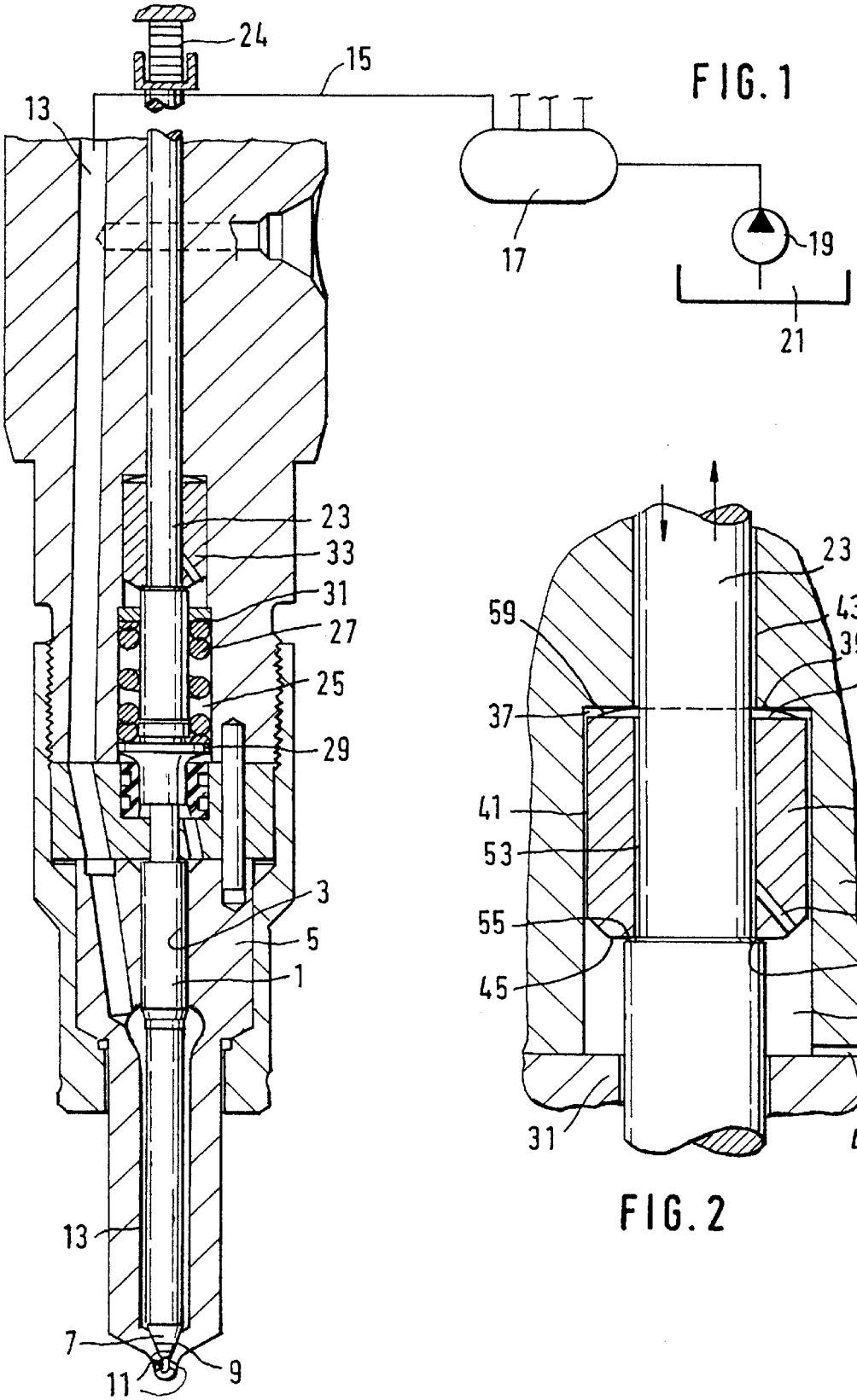
FIG. 1 shows a first exemplary embodiment in a longitudinal section through the fuel injection valve.

In the fuel injection valve for internal combustion engines, shown in FIG. 1, a pistonlike valve member 1 is guided axially in a guide bore 3 of a valve body 5. The valve member 1, on its side toward the combustion chamber, has a valve sealing face 7, with which it cooperates with a valve seat face 9 on the valve body 5, disposed on the end toward the combustion chamber of the guide bore 3, in order to control an injection cross section.

Downstream of the valve seat face 9, an injection port 11 is provided in the valve body 5; beginning at a pressure conduit 13 extending in the valve body 5, this port discharges into the combustion chamber of the engine to be supplied. The pressure conduit 13 communicates via an injection line 15 with a high-pressure storage chamber 17, shown schematically, which is filled with fuel at high pressure from a storage tank 21 by a high-pressure fuel pump 19, and from which all the injection lines lead away to the individual fuel injection valves (hence this chamber 17 is known as a common rail).

The valve member 1 is actuated by a piezoelectric final control element, to which end a piezostack 24, shown in simplified form, is coupled to the end of the valve member 1 remote from the valve seat via a piezostack connecting rod 23. This piezostack 24 is formed of a number of piezoelectric disks disposed axially one after the other, the axial lengths of the disk being variable by the application of a voltage. In order to keep the valve member 1, in its position of repose and in its pressureless state, securely in contact with the valve seat face 9, a valve spring 27 disposed in a spring chamber 25 is also provided; the valve spring is fastened between the spring plate 29 and plate 31 which seats on a shoulder solidly joined to the housing, and it actuates the valve member 1 in the direction of the valve seat face 9.

For damping of the valve member 1 in an intermediate position between its contact with the valve seat 9 and the maximum opening stroke position, a damping member on the fuel injection valve is provided, which in the first exemplary embodiment is formed by a piston 33 that is axially displaceable on the shaft of the piezostack connecting rod 23. This piston 33, shown on a larger scale in FIG. 2, can alternatively be disposed on the shaft of the valve member 1 instead.

The damping piston 33 is guided with its outer circumference sliding along the inner wall of the spring chamber 25 surrounding the piezostack connecting rod 23, and with its upper end face 35, remote from the valve member 1, it defines a damping chamber 37 that is defined on its other end by a wall 39, solidly joined to the housing, formed by a shoulder. The damping chamber 37 is sealed off from the outside by the narrow gap 41 between the piston 33 and the wall of the spring chamber 25, and by the narrow gap size 43 between the piezostack connecting rod 23 and the housing wall of the valve body 5.

With its lower end face 45, toward the valve member 1, the piston 33 defines a storage chamber 47, which is defined on its other end by the shoulder 31 acting as a spring rest for the valve spring 27, and it is filled with a hydraulic pressure medium, preferably fuel, via an inlet line 49; the pressure in the storage chamber 47 is kept virtually constant by suitable valve controls. The damping chamber 37 communicates constantly with the storage chamber 47 via a throttle line; in the exemplary embodiment, the throttle line is formed by a throttle bore 51, which extends obliquely away from an annular gap formed between the shaft of the piezostack connecting rod 23 and the wall of the bore of the piston 33; the annular gap thus forms a further connecting conduit 53 between the damping chamber 37 and the storage chamber 47. This connecting conduit 53, which has an enlarged flow cross section compared to the throttle bore 51, can be opened at the onset of the opening stroke motion of the valve member 1 by means of a shoulder on the shaft of the piezostack connecting rod 23. The shoulder of the piezostack connecting rod 23 is embodied as a sealing seat 55, which in the first exemplary embodiment is conical (cone seat), and against which a sealing face 57 provided on the piston 33 comes to rest, this sealing face being formed by the radially inner region of the lower piston end face 45 adjoining the annular gap 53.

For restoring the damping piston 33 after the downward-directed closing stroke motion of the valve member 1 and of the piezostack connecting rod 23, a restoring spring 59 is also fastened between the upper piston end face 35 and the housing wall 39 in the damping chamber 37; because of the relatively small reciprocating motions, it is preferably embodied as a cup spring.

The fuel injection valve according to the invention for internal combustion engines functions as follows.

From the common high-pressure storage chamber 17, filled by the high-pressure pump 19, the fuel, which is at high pressure, passes via the injection line 5 and the pressure conduit 13 in the injection valve to reach the valve seat 9; the sealing face 7 of the valve member 1 that contacts the valve seat face in the closing state of the injection valve keeps an opening cross section to the injection ports 11 closed.

If injection is to take place at the fuel injection valve, then via an electronic control unit the voltage at the piezostack 24 is varied; as a consequence, the axial length of the piezostack 24 decreases. The piezostack 24 displaces the valve member 1, coupled to it via the piezostack connecting rod 23, in the opening direction, causing the valve member 1 with its sealing face 7 to lift from the valve seat face 9 and uncovering an opening cross section, by way of which the fuel flows out of the pressure conduit 13 to the injection ports 11 and on into the combustion chamber of the engine to be supplied. For shaping of the course of injection, it is necessary in certain operating states of the invention initially to open up only a small partial opening cross section at the injection valve, so that initially only a partial injection quantity reaches the combustion chamber of the engine. To that end, the voltage at the piezostack 24 is regulated in such a way that the piezostack persists in its position, so that the valve member 1 coupled to it also persists in an intermediate position between contact with the valve seat 9 and the maximum opening stroke.

In this intermediate position, in order to suppress vibration of the valve member 1, the damping device becomes operative in this position.

With the onset of the opening stroke motion of the valve member 1 and of the piezostack connecting rod 23, the sealing face 57 of the piston 33 first comes to rest on the sealing seat 55, and thus the connecting conduit 53 is closed. As the valve member stroke continues, the fuel flows out of the damping chamber 37 into the storage chamber 47 via the throttle bore 51; the cross section of the throttle bore 51 is dimensioned such that the reciprocating motion of the valve member 1 is not substantially slowed.

When the valve member 1 and the piezostack connecting rod 23 are stopped, the damping chamber 37 now acts as a unilateral spring damper, which suppresses axial vibration of the valve member 1 and fixes the valve member 1 in its position via the piezostack connecting rod 23.

If the reciprocating motion of the valve member 1 is to be continued as far as the maximum opening position, then the voltage at the piezostack 24 is varied again, and the piezostack connecting rod 23 displaces the valve member 1 into the maximum position, overcoming the damping force at the piston 33.

For closing the injection valve, the voltage at the piezostack 24 is varied one again, in such a way that its axial length, in the variant shown, increases; the sealing seat 55 lifts away from the sealing face 57 on the piston 33, allowing the fuel to flow unthrottled out of the storage chamber 47 into the damping chamber 37, which prevents the development of negative pressure there. To assure the quickest possible closure of the connecting conduit 53 on the piston 33 after the onset of the opening stroke, the restoring spring 59 also displaces the piston 33 in the direction of the sealing seat 55 in the intervals between injections.

Figure 2:
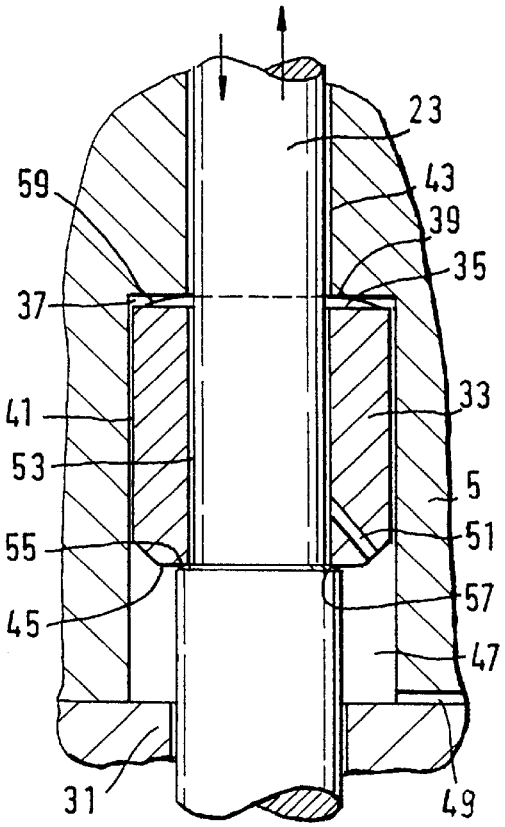
FIG. 2 is an enlarged view of the unilaterally acting damping device of FIG. 1, with a conical sealing seat on the piston.
Figure 3:
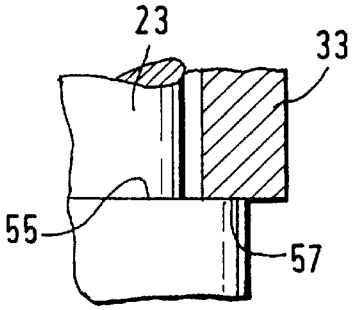
FIG. 3 shows a second exemplary embodiment in a detail of FIG. 2, in which the sealing seat on the piston is embodied as a flat seat.

The second exemplary embodiment shown in FIG. 3 differs from the first exemplary embodiment shown in FIGS. 1 and 2 only in the embodiment of the sealing seat 55 on the piezostack connecting rod 23; this sealing seat is now embodied as a flat seat.

Figure 4:
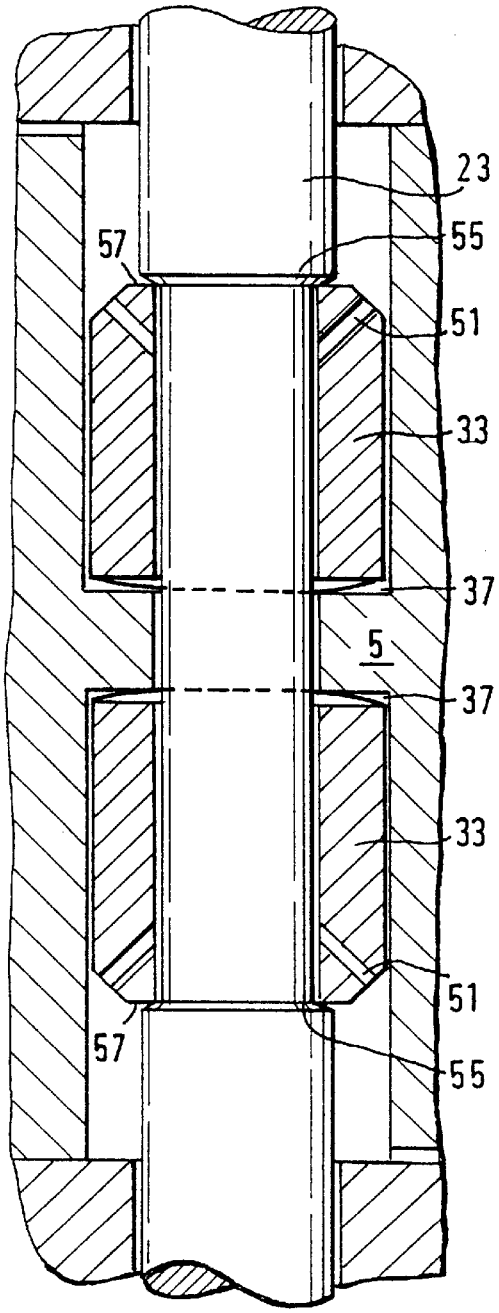
FIG. 4 shows a third exemplary embodiment with a bilaterally acting damping device, which is formed by two mutually independent pistons.

In the third exemplary embodiment shown in FIG. 4, for bilateral damping of the valve member, two pistons 33 are provided on the shaft of the piezostack connecting rod 23; with their end faces toward one another, they each define one damping chamber 37, each of which chambers acts in one direction on the piezostack connecting rod 23 and also on the valve member 1. The structure and function of the individual damping devices are entirely equivalent to the design described in FIGS. 1 and 2 for the first exemplary embodiment. Only when the valve member 1 persists in an intermediate position is a now bilateral damping force transmitted via the piezostack connecting rod 23 to the valve member 1, which even more effectively suppresses possible vibration.

In the second, upper piston 33 as well, the throttle bores 51 are designed such that the reciprocating motion of the valve member is not substantially affected; moreover, the development of negative pressure in the damping chamber 37 is prevented by the lifting of the sealing face 57 from the sealing seat 55.

Figure 5:
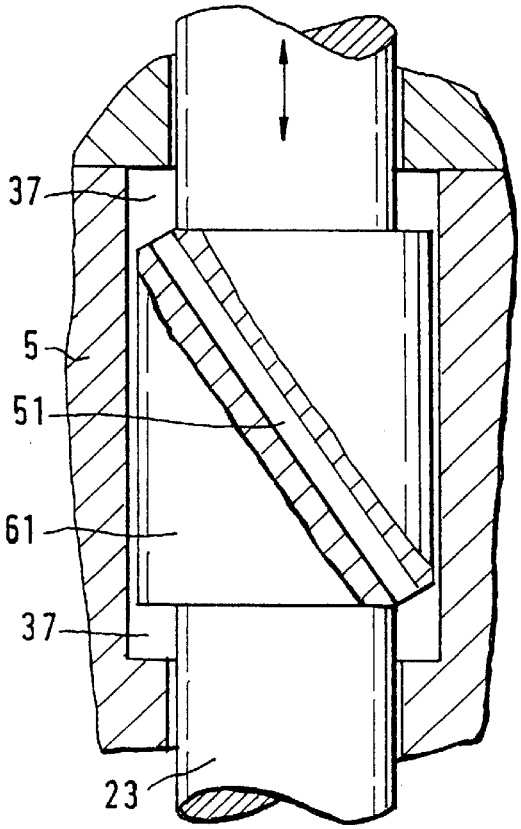
FIG. 5 shows a fourth exemplary embodiment, in which the bilaterally acting damping device has only one common movable piston.

FIG. 5 shows a fourth exemplary embodiment, in which the two-sided damper from FIG. 4 is shown structurally simplified, with a single movable piston.

This double piston 61, disposed fixedly on the shaft of the piezostack connecting rod 23 (a disposition on the valve member shaft or on an intermediate piston is alternatively possible instead), with its end faces, defines two damping chambers 37 in the valve body 5, which communicate with one another through a preferably diagonal throttle bore 51. The damping chambers 37 have an adequately high preliminary pressure that negative pressures as the volume increases are reliably avoided.

With the fuel injection valve of the invention, it is thus possible in a structurally simple way to shape the injection course in such a way that a partial opening cross section on the injection valve can be opened for a freely adjustable length of time and is not impaired by valve member vibration. It is alternatively possible for the damping device shown to directly engage the valve member, the piezostack or a connecting rod.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A fuel injection valve for injecting fuel into a combustion chamber of an internal combustion engine, comprising a valve body (5), a valve member (1) guided axially displaceably in said valve body (5), said valve member includes a sealing face (7) provided on an end toward the combustion chamber, said sealing face cooperates with a valve seat face (9) provided on the valve body (5) in order to control an injection port (11), an end of the valve member away from the combustion chamber is coupled to a piezoelectric final control element including a piezoelectric stack (24), a length of said piezoelectric stack is adjustable under an influence of a control voltage for actuating the valve member (1) to a partial open intermediate position and to a maximum open stroke position, and during a stoppage in the intermediate position of the valve member (1) between a closing stroke position and the maximum opening stroke position, a damping member (33) in a damping chamber acts on the valve member to control the stroke motion.

2. A fuel injection valve in accordance with claim 1, in which the valve member (1) is coupled with said damping member, which is displaced in a bore in said valve body in accordance with the valve member opening or closing motion, and in the process of the opening or closing motion encloses a damping chamber in the bore.

3. A fuel injection valve in accordance with claim 1, in which the damping member is formed by an axially displaceable piston (33), disposed on a shaft of the piezoelectric stack connecting rod (23), said piezoelectric stack connecting rod includes a sealing seat (55) on one end which piston with one end face (35) defines a damping chamber (37) and with another end face (45) defines a storage chamber (47), the damping chamber (37) and storage chamber (47) communicates with one another via at least one connecting conduit.

4. A fuel injection valve in accordance with claim 2, in which the damping member is formed by an axially displaceable piston (33), disposed on a shaft of a piezoelectric stack connecting rod (23), which piston with one end face (35) defines a damping chamber (37) and with another end face (45) defines a storage chamber (47), the damping chamber (37) and storage chamber (47) communicates with one another via at least one connecting conduit.

5. A fuel injection valve in accordance with claim 3, in which a second connecting conduit (53) is provided between the storage chamber (47) and the damping chamber (37), in which the second connecting conduit is closed at an onset of the opening stroke motion of the valve member (1) by said sealing seat (55), and said sealing seat is formed by means of a shoulder on the shaft of the piezoelectric stack connecting rod (23).

6. A fuel injection valve in accordance with claim 4, in which a second connecting conduit (53) is provided between the storage chamber (47) and the damping chamber (37), in which the second connecting conduit is closed at an onset of the opening stroke motion of the valve member (1) by said sealing seat (55) and said sealing seat is formed by means of a shoulder on the shaft of the piezoelectric stack connecting rod (23).

7. A fuel injection valve in accordance with claim 5, in which an end face (45) of the movable piston (33) adjoins the storage chamber (47), the movable piston (33) is guided on the shaft of the piezoelectric stack connecting rod (23) and forms a sealing face (57) that cooperates with the sealing seat (55) on the piezoelectric stack connecting rod (23).

8. A fuel injection valve in accordance with claim 6, in which an end face (45) of the movable piston (33) adjoins the storage chamber (47), the movable piston (33) is guided on the shaft of the piezoelectric stack connecting rod (23) and forms a sealing face (57) that cooperates with the sealing seat (55) on the piezoelectric stack connecting rod (23).

9. A fuel injection valve in accordance with claim 7, in which the connecting conduit (53) is formed between the shaft of the piezoelectric stack connecting rod (23) and a wall of a through bore on the piston (33).

10. A fuel injection valve in accordance with claim 8, in which the connecting conduit (53) is formed between the shaft of the piezoelectric stack connecting rod (23) and a wall of a through bore on the piston (33).

11. A fuel injection valve in accordance with claim 7, in which the sealing seat (55), provided on the shaft of the piezoelectric stack connecting rod (23), is embodied as a flat seat.

12. A fuel injection valve in accordance with claim 8, in which the sealing seat (55), provided on the shaft of the piezoelectric stack connecting rod (23), is embodied as a flat seat.

13. A fuel injection valve in accordance with claim 7, in which the sealing seat (55), provided on the shaft of the piezoelectric stack connecting rod (23), is embodied as a conical seat face.

14. A fuel injection valve in accordance with claim 8, in which the sealing seat (55), provided on the shaft of the piezoelectric stack connecting rod (23), is embodied as a conical seat face.

15. A fuel injection valve in accordance with claim 9, in which the connecting conduit is formed by at least one throttle bore (51), which penetrates the movable piston (33) and leads obliquely away from the connecting conduit (53) and discharges into the storage chamber (47) outside the sealing face (57).

16. A fuel injection valve in accordance with claim 3, which includes a second movable piston (33) which defines a second damping chamber (37) and storage chamber (47), and the second damping chamber acts upon the valve member (1) in an opposite direction from the first damping chamber.

17. A fuel injection valve in accordance with claim 16, in which the first and second pistons are embodied as a common double piston (61), in which opposite end faces define one damping chamber, that acts in opposition directions on the valve member, and the damping chambers communicate constantly with one another through a throttle bore (51).

18. A fuel injection valve in accordance with claim 1, in which the valve member (1) is kept in contact at the valve seat (9) by a valve spring (27).

19. A fuel injection valve in accordance with claim 4, in which in the damping chamber (37), a restoring spring (59), is provided which urges the movable piston (33) in the direction of the sealing seat (55).

20. A fuel injection valve in accordance with claim 1, in which an injection line (15) communicates with a high-pressure storage chamber (17) from which a number of injection lines lead away, and said high pressure storage tank is filled with fuel at a high pressure by a high-pressure fuel pump (19).

* * * * *